United States Patent [19]

Behman

[11] 4,331,074

[45] May 25, 1982

[54] COVER AND COMPACTING ASSEMBLY FOR TRASH CANS

[76] Inventor: Rafik R. N. Behman, 115 Magnolia Ave., Jersey City, N.J. 07306

[21] Appl. No.: 203,351

[22] Filed: Nov. 3, 1980

[51] Int. Cl.[3] ..... B30B 15/30

[52] U.S. Cl. ..... 100/215; 100/227; 100/245; 100/246; 100/295; 220/1 T

[58] Field of Search ..... 100/240, 245, 215, 229 A, 100/226, 227, 228, 246, 247, 248, 265, 295; 220/1 T; 215/231

[56] References Cited

U.S. PATENT DOCUMENTS

| | | | |
|---|---|---|---|
| 202,093 | 4/1878 | Clabaugh | 215/231 |
| 928,562 | 7/1909 | Teml | 100/227 |
| 2,465,839 | 3/1949 | Bloomfield | 100/228 |
| 3,736,863 | 6/1973 | Brucker | 100/228 |
| 3,749,274 | 7/1973 | Mele | 220/1 T |
| 3,760,718 | 9/1973 | Adornetto | 100/227 |
| 3,779,157 | 12/1973 | Ross | 100/240 |
| 3,835,769 | 9/1974 | Peterson | 100/227 |

FOREIGN PATENT DOCUMENTS

| | | | |
|---|---|---|---|
| 970757 | 9/1964 | United Kingdom | 100/240 |

*Primary Examiner*—Billy J. Wilhite
*Attorney, Agent, or Firm*—Daniel H. Bobis

[57] ABSTRACT

A combined cover and compactor assembly capable of being mounted on a container for trash or other compactible material has a housing having at least one side wall defining a transfer and compacting chamber therein. The housing has a side opening located in the side wall serving as an inlet to permit the compactible material to be charged into the transfer and compacting chamber, and a lower end opening in registry with the transfer and compacting chamber. The housing is connectible to the container by a housing support that is adjacent and defines the lower end opening to allow compactible material charged into the transfer and compacting chamber through the side opening to either fall or be forced into the container. A retainer assembly including an upper end opening is disposed at the upper end of the housing to releasably support a compactor within the transfer and compacting chamber. The compactor may act as a cover when it is held by the retaining assembly, or may be disengaged from the retaining assembly to move downward to exert compacting force upon the compactible material present in the transfer and compacting chamber.

19 Claims, 13 Drawing Figures

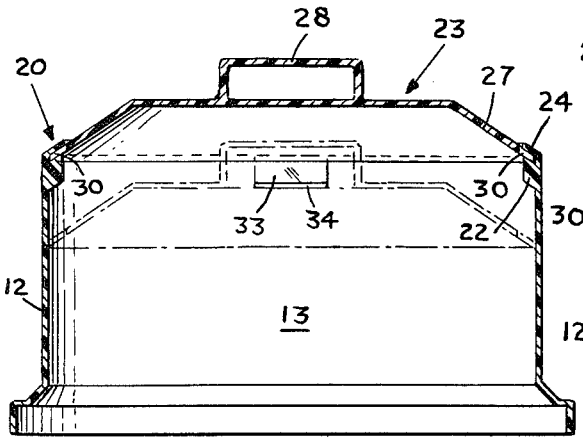
FIG. 5
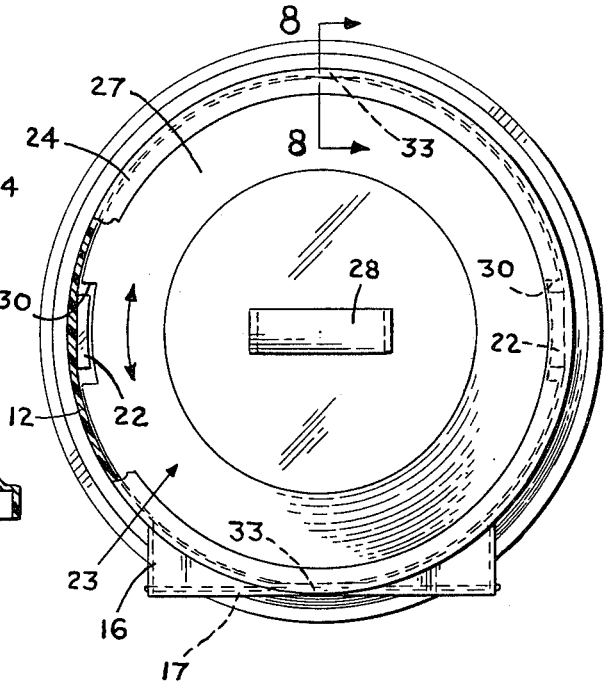
FIG. 5A
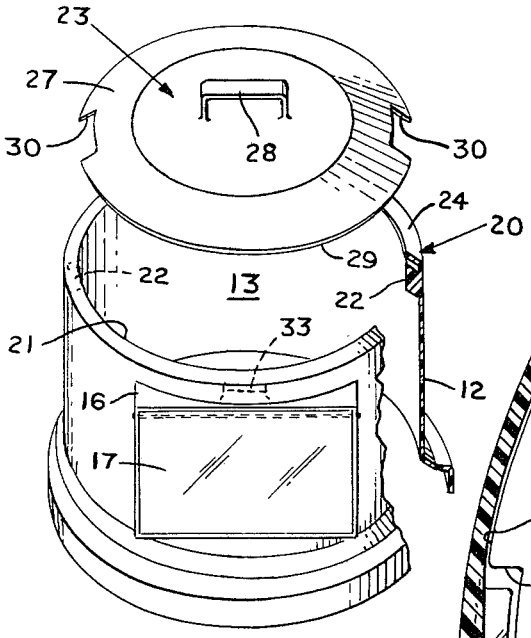
FIG. 6
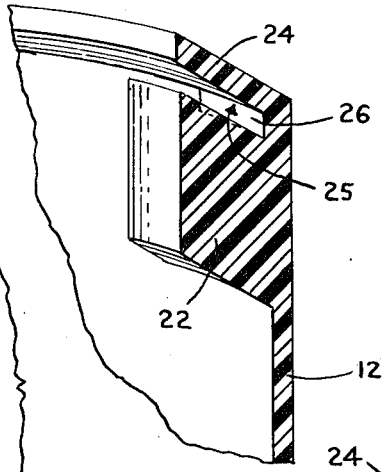
FIG. 7
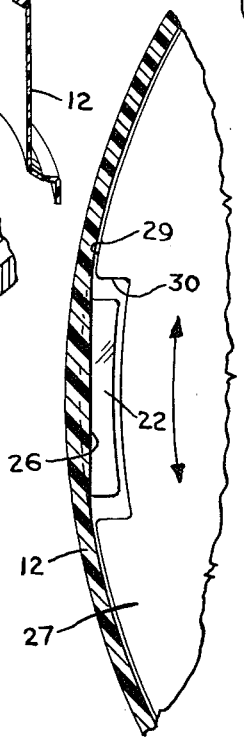
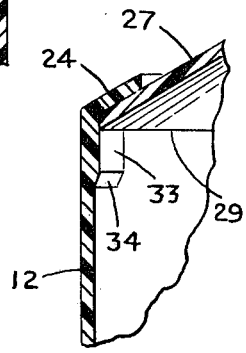
FIG. 8
FIG. 5B

COVER AND COMPACTING ASSEMBLY FOR TRASH CANS

BACKGROUND OF THE INVENTION

The present invention relates to trash compactors, and in particular to trash compactors useful with trash or garbage cans.

Trash compactors, including those useful in cooperation with trash cans are known. Also, trash compactors utilizing a plunger that presses downward to compact the trash within a chamber communicating with the trash can are likewise well documented. For example, U.s. Pat. No. 3,760,718 to Adornetto is illustrative of a recent development, wherein a compactor comprising a plunger having a handle adapted to coact with a lever arrangement mounted on a supporting frame, may be secured to the open upper end of a trash can, and utilized to compress the trash therewithin.

The Adornetto device, like many of the devices extant in the prior art, is complex and cumbersome, and is inconvenient to use, if one wishes to place a cover over the trash can to isolate the trash from the room atmosphere in the instance where the trash can is maintained indoors.

Finally, many trash compactors operate by means of mechanical assistance by motors and the like, which may require attachment to an electrical outlet with consequent energy consumption, and the risk of mechanical failure requiring servicing.

SUMMARY OF THE INVENTION

A combined cover and compactor assembly which may be attached to a container for compactible material comprises a housing having at least one side wall defining a transfer and compacting chamber, an inlet comprising a side opening communicating with the transfer and compacting chamber through which compactible material may be charged to the chamber, and an outlet comprising a lower end opening located at the lower end of the housing in registry with the chamber, to permit compactible material charged through the inlet to pass through and out of the chamber. The housing includes a housing support located adjacent and defining the lower end opening, for mounting the cover and compactor assembly on the container, so that compactible material may be discharged directly into the container from the transfer and compacting chamber. Retaining means including an upper end opening is located at the upper end of the housing to releasably engage a compactor. The compactor serves as a cover for the cover and compactor assembly when held by the retaining means, and is disengageable from the retaining means to serve as a compactor to exert force upon the compactible material in the transfer and compacting chamber.

The cover and compactor assembly preferably has a cylindridcal transfer and compacting chamber, and the housing support comprises a shoulder located adjacent the lower end opening to rest on the rim of the open end of the container when the assembly is mounted thereon. The retaining means for this structure comprises at least two regularly spaced locking lugs that project from the inner surface of the side wall into the transfer and compacting chamber, and an inwardly directed rim located in spaced apart relation above the locking lugs and extending from the side wall to define the upper end opening. The locking lugs and the rim cooperate to define a retaining track to peripherally engage the compactor when it functions as a cover. In a preferred embodiment, portions of the side wall extending between the rim and each locking lug as well as regularly therebetween, are slightly thickened to assure tangential abutment between the side wall and the peripheral edge of the compactor.

The compactor is essentially disc-like and has a generally circular perimeter defined by a peripheral edge. The perimeter of the compactor is larger than that of the upper end opening, but smaller than the cross sectional perimeter of the transfer and compacting chamber, so that when the compactor is brought into engagement with the retaining means, the inwardly extending rim overlaps the upper surface of the compactor to secure it in position and assist it in serving as a cover for the assembly. The compactor preferably comprises a plunger having a handle attached to one broad surface thereof, with the handle projecting away from the assembly when the compactor is positioned therein.

Accordingly, it is a principal object of the present invention to provide a cover and compactor assembly for use with containers for trash and other compactible material.

It is a further object of the present invention to provide an assembly as aforesaid which may be manually operated.

It is a yet further object of the present invention to provide an assembly as aforesaid which may be simply and inexpensively constructed.

Other objects and advantages will become apparent from a consideration of the specification taken with reference to the following illustrative drawings.

BRIEF DESCRIPTION OF THE DRAWINGS

FIG. 5 is a side sectional view of the cover and compactor assembly of FIG. 4, also showing the compactor during a compacting operation in phantom view.

FIG. 5A is a top plan view in part broken away of the cover and compactor assembly shown in FIG. 5.

FIG. 5B is an enlarged horizontal fragmentary view of the locking lug and cut-out shown in FIG. 5A.

FIG. 6 is an exploded perspective view, partly broken away, of the cover and compactor assembly shown in FIG. 1.

FIG. 7 is a vertical fragmentary enlarged view of the locking lug shown in section in FIG. 6.

FIG. 8 is an enlarged vertical fragmentary view taken through line 8—8 of FIG. 7.

DETAILED DESCRIPTION OF THE INVENTION

Figure 1:
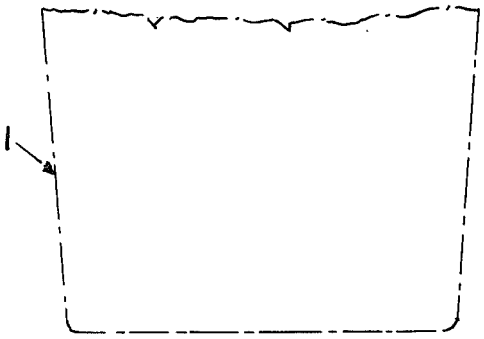
FIG. 1 is a front elevational view partly broken away showing the cover and compactor assembly mounted on a trash container.
Figure 3:
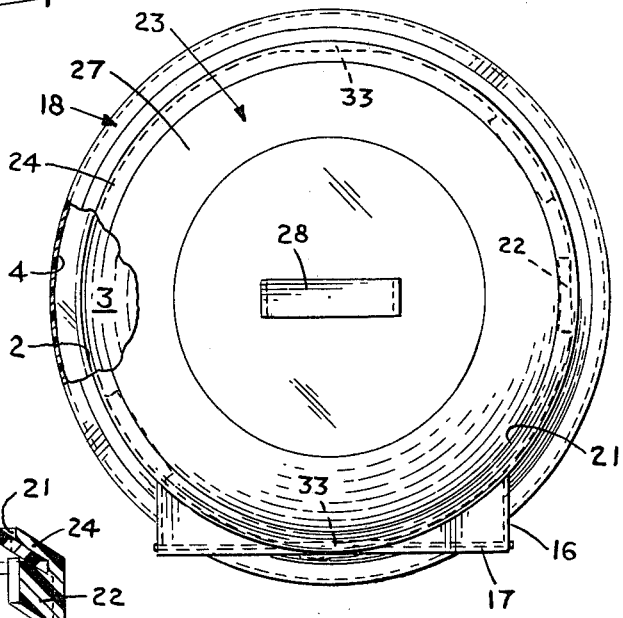
FIG. 3 is a top view partly broken of the cover and compactor assembly shown in FIG. 1.

Referring to the drawings, FIGS. 1–8 illustrate the combined cover and compactor assembly of the present invention, which, as illustrated in FIG. 1, may be mounted on a container such as a trash can generally labeled 1. Trash can 1 has an opening 2 to receive trash which is held in compartment or space 3. Opening 2 is defined by annular flange 4 which helps opening 2 to retain its shape. The specific size or shape of flange 4, as with all of trash can 1 may vary widely as is well known by those skilled in the art.

Presentation of trash can 1 is for purposes of illustration only, and the present invention is applicable to any type of container having an upper opening, which receives compactible material therein.

COVER AND COMPACTOR ASSEMBLY

Cover and compactor assembly 10 has a housing 11 which, as illustrated, may assume a generally cylindrical shape. Housing 11 has a side wall 12 that defines an inner transfer and compacting chamber 13. Transfer and compacting chamber 13 communicates with an inlet comprising side opening 14 located medially in side wall 12 to permit the trash or other compactible material to be charged into transfer and compacting chamber 13. An outlet is provided at the lower end of housing 11, comprising lower end or discharge opening 15, which communicates with transfer and compacting chamber 13, and with the compartment 3 when it is mounted on trash can 1, as is shown in FIG. 1.

For the purposes of the present Application, the term "generally cylindrical shape" is intended to encompass those instances where the housing 11 may define a cylinder, with a circular cross section, as well as those instances were the cross section may by polygonal. Correspondingly, transfer and compacting chamber 13 may also define a polygonal cross section within the scope of the present invention.

Figure 2:
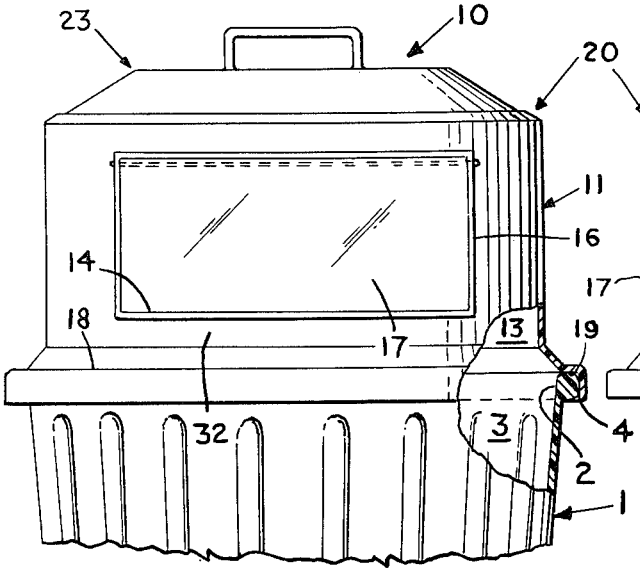
FIG. 2 is a left side elevational view partly in phantom of the cover and compactor assembly shown in FIG. 1.
Figure 2:
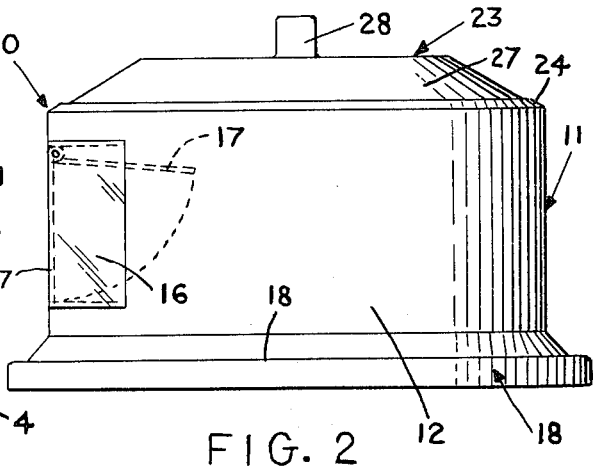

The inlet is defined by side opening 14 which is illustrated in the FIGURES as essentially planar, and is defined by an annular generally rectangular frame 16 that projects radially outward from transfer and compacting chamber 13, to minimize interference with the compaction of materials within transfer and compacting chamber 13. The inlet may also include a door 17 that may be pivotally attached to either frame 16 or side opening 14, the exact mounting and operation of door 17 being variable within the skill of the art. As illustrated in FIG. 2, door 17 is pivotally mounted to the top most edge of frame 16 and is adapted to permit compactible material to be charged into chamber 13. Door 17 is desirably provided in the instance where cover and compactor assembly 10 is used to compact trash or other materials having noxious odors whose escape into the atmosphere would constitute a health hazard.

The lower end of housing 11 is provided with a housing support 18 that is adjacent and defines lower end opening 15. Housing support 18 enables cover and compactor assembly 10 to be mounted on a container such as trash can 1, as it firmly seats on opening 2. Housing support 18 may vary in shape to accommodate like variations in the size and configuration of container openings, and therefore the configuration shown in the drawings is presented for purposes of illustration only.

Housing support 18 provides a shoulder 19 which directly rests on the opening of the container, and defines the mouth of lower end opening 15. Housing support 18 as illustrated is annularly larger than side wall 12, however the invention is not limited to this configuration, as side wall 12 may be enlarged or increased in thickness to conform in size to housing support 18. Shoulder 19 may extend inward to define bevel 19A, which is provided to aid in the return of the compactor 23 to its starting position shown in FIG. 1, in the instance where the compactor has been thrust downward and out of chamber 13 into trash can 1. Thus, the edge of compactor 23 may ride against bevel 19A and thereby be guided into chamber 13 in the return motion. Also, in the instance where trash can 1 is used with a trash can liner, not shown, the provision of the bevel 19A leading to a reduced diameter chamber 13 minimizes the likelihood that the compactor 23 will snag the trash can liner during its return into the chamber 13.

Cover and compactor assembly 10 includes a retaining means generally at 20, that is located at the upper end of housing 11. Retaining means 20 defines an upper end opening 21 that provides an access to the compactor, to operate cover and compactor assembly 10. Upper end opening 21 is illustrated in the figures as circular, however its shape is not critical and the invention is not limited thereto.

Figure 4C:
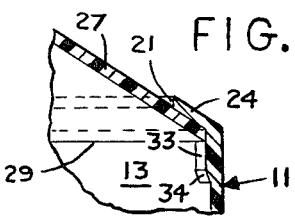
FIG. 4C is an enlarged fragmentary view taken through line 4C—4C in FIG. 4.
Figure 4B:
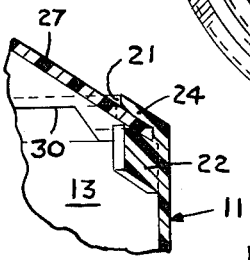
FIG. 4B is an enlarged vertical fragmentary view of the retaining means shown in FIG. 4.
Figure 4:
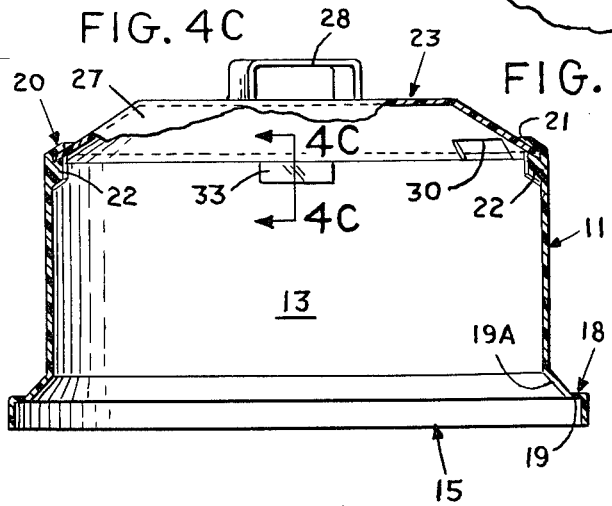
FIG. 4 is a side sectional view showing the cover and compactor assembly of FIG. 1 with the compactor in engagement with the retaining means.

Referring to FIGS. 4 to 7, retaining means 20 comprises at least two regularly spaced locking lugs 22 that project into transfer and compacting chamber 13 from side wall 12. Retaining means 20 also includes an inwardly directed rim 24 that extends as shown from the top of side wall 11 and terminates to define upper end opening 21. As illustrated in FIG. 4, rim 24 and lugs 22 cooperate to retain compactor 23 at the upper end of housing 11, so that compactor 23 may serve as a cover when it is not used to compact trash or other material. Lugs 22 and rim 24 coact together with the interstitial portion of side wall 12 to define a retaining track 25 that receives and secured compactor 23, as will be described below.

Lugs 22 may vary in number from a minimum of two, illustrated herein, and are preferably regularly spaced to provide even support for compactor 23. As shown in FIGS. 4 and 7, retaining track 25 is defined by the generally parallel adjacent surfaces of lugs 22 and rim 24, and is sized to permit compactor 23 to slide therethrough. The provision of lugs 22 as part of the retaining means illustrates one aspect of the invention.

Retaining means 20 also defines a braking means for peripherally engaging the compactor 23 when it is held thereby. In one embodiment of the present invention, best shown in FIGS. 5B and 7, side wall 12 is thickened at the portion thereof located between lugs 22 and rim 24 to frictionally engage the outermost portion of the perimeter of compactor 23, when it is rotated into slidable engagement therewith. The increased thickness is better shown in FIG. 5B, where a braking surface 26 is shown as a flattening of the curvature of side wall 12 to define an increase in thickness over a length corresponding to the width of lug 22. Braking surface 26 at its maximum protrusion, roughly at its center, is adapted to extend into the annular gap that is provided between the perimeter of transfer and compacting chamber 13 and the outermost perimeter of compactor 23. Braking surface 26 makes tangential contact with the perimeter of compactor 23 and maintains it in snug engagement with retaining means 20 when compactor 23 serves as a cover for housing 11.

Referring to FIGS. 5A and 8, the braking means includes auxiliary braking surfaces 33 that may be located intermediate braking surfaces 26 as shown. Braking surface 33 extends in similar manner to braking surface 26 to abut at its centermost portion with the perimeter of compactor 23. Braking surface 33 extends downward as shown and terminates in tapered braking surface land 34, that extends outwardly into smooth transition with the inner surface of side wall 12. Braking surface land 34 is provided to assist upward movement of compactor 23, as it provides a guide for the outer perimeter of the compactor to ride into engagement with the auxiliary braking surface 33. Auxiliary braking surfaces 33 may be regularly spaced along the perimeter of transfer and compacting chamber 13, so as to lie intermediate braking surfaces 26. In one embodiment, braking surface 26 and auxiliary braking surface 33 may be defined by a thickened wall segment providing an extension of the inner surface of side wall 12 into transfer and compacting chamber 13, the additional thickness of this segment ranging about 1 mm. Naturally, the exact thickness of the wall segment may vary with the design and size of the cover and compactor assembly, and the invention is accordingly not limited thereto.

Compactor 23 comprises a disc-like plunger 27 having generally parallel broad surfaces, the lower of which contacts the compactible material during the compacting cycle illustrated in FIG. 5. The handle 28 is attached to the upper broad surface of plunger 27 so that compactor 23 may be manually raised and lowered within transfer and compacting chamber 13. Plunger 27 has a generally circular peripheral edge 29, a portion of which frictionally abuts with braking surfaces 26 and 33 as described above. Peripheral edge 29 is larger in perimeter than the upper end opening 21, so that compactor 23 can be securely engaged between the upper surface of lugs 22 and the inner surface of rim 24 during its storage. Also, this difference in size prevents compactor 23 from lifted directly upward and out of transfer and compacting chamber 13; instead, compactor 23 moves reciprocally within transfer and compacting chamber 13 as illustrated in FIGS. 4 and 5.

Figure 4A:
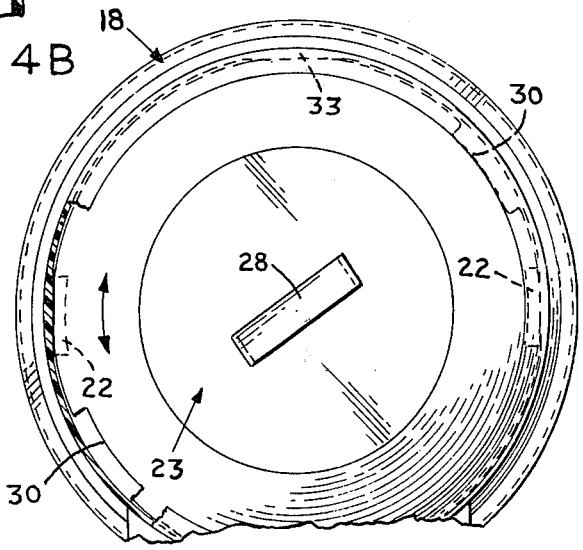
FIG. 4A is a top plan view partly broken and partly in phantom showing the cover and compactor assembly of FIG. 4.

Compactor 23 further includes release means enabling compactor 23 to escape from retaining means 20 during the compacting operation. The release means comprises cut-outs 30 in peripheral edge 29 that correspond in shape to lugs 22 and are sized to provide a clearance therebetween, as shown in FIG. 4A. Cut-outs 30 correspond in number to lugs 22, and are located along peripheral edge 29 so that, when cut-outs 30 are in alignment with lugs 22, compactor 23 may escape downward from retaining means 20.

OPERATION

As described earlier, cover and compactor assembly 10 may be mounted on a suitable container such as trash can 1, illustrated in FIG. 1. In the instance where cover and compactor assembly 10 is not being used to compact trash, compactor 23 is held in the position shown in FIGS. 1 through 4. Compactor 23 is brought into this position by first grasping handle 28, and then rotating compactor 23 until cut-outs 30 are in alignment with lugs 22. Handle 28 may then be pulled upward to bring compactor 23 past lugs 22 to its uppermost position within transfer and compacting chamber 13. At this point, plunger 27 contacts the adjacent surface of rim 24 and cut-outs 30 have cleared lugs 22 and enter retaining track 25. Compactor 23 is then rotated either clockwise or counter-clockwise until cut-outs 30 and lugs 22 are no longer in alignment, and an outermost portion of peripheral edge 29 frictionally engages braking surfaces 26 and 33. Compactor 23 need not be rotated beyond this point, as it will remain securely positioned within retaining means 20, and will thereby serve as a cover for cover and compactor assembly 10.

When it is desired to compact a quantity of material within cover and compactor assembly 10, the compactible material is first charged into transfer and compacting chamber 13 through side opening 14. In the instance where side opening 14 is fitted with a door such as door 17, the door closes automatically after all of the compactible material is placed inside transfer and compacting chamber 13.

Compactor 23 is then readied for the compacting operation, and handle 28 is grasped and rotated until cut-outs 30 are aligned with lugs 22. Practically, alignment will be evident when compactor 23 is suddenly free to move downward past lugs 22. In the instance where lugs 22 and cut-outs 30 are aligned, as illustrated in FIGS. 5 and 5A, compactor 23 may then be thrust downward into the position illustrated in phantom in FIG. 5, and force may be exerted to cause the trash to either compact or move within transfer and compacting chamber 13, down and into an adjacent area such as compartment 3 of trash can 1. After all of the material is compacted, compactor 23 may be raised back into engagement with retaining means 20, as described earlier. When the associated container such as trash can 1 becomes full, cover and compactor assembly 10 may be simply removed from the full container and placed on the next empty container to be used.

As noted earlier, the cover and compactor assembly of the present invention may be designed with certain variations in construction, depending upon intended application. In the instance where compactor assembly 10 is to be used with trash cans, side opening 14 may be located closer to the upper end of housing 11, and side wall 12 may extend between the lower edge of opening 14 and the upper edge of housing support 18 to define a lip 32. Lip 32 would be useful in the instance where the trash charged into transfer and compacting chamber 13 includes liquid ad semi-solid material, so that the material would not run out of chamber 13 before it is compacted. Also, compactor 23 is illustrated as having a beveled, frustoconical border that corresponds and mates with similarly configured adjacent surfaces of rim 24 and lugs 22. The specific angle or bevel of these elements may vary, and, for example compactor 23 may be a flat disc, in which instance lugs 22 and rim 24 would define a corresponding track 25.

Cover and compactor assembly 10, including housing 11 and compactor 23 may be prepared from a variety of well known durable materials including metals such as aluminum, stainless steel and the like, and suitably durable plastic materials. The invention is not limited to a particular material but rather encompasses all materials suitable for use herein.

It will be understood that the invention is not to be limited to the specific construction or arrangement of parts shown but that they may be widely modified within the invention defined by the claims.

What is claimed is:

1. A combined cover and compactor assembly for mounting on a container having an open end and used for holding compactible material comprising:

a. a housing having a side wall defining a transfer and compacting chamber,
b. said side wall having a side opening communicating with said transfer and compacting chamber for charging compactible material thereinto,
c. said housing having a lower end opening in communication with said transfer and compacting chamber for discharging compactible material therefrom,
d. said housing having a housing support about the lower end for connecting the combined cover and compactor assembly to the open end of said container,
e. retaining means located at the end of said housing remote from the lower end opening, and
f. a compactor detachably connectible in said retaining means and to be disengaged therefrom for downward movement to exert compacting forces upon collected compactible material in said transfer and compacting chamber.

2. In the combined cover and compactor assembly as claimed in claim 1 wherein:
a. said side wall is generally cylindrically shaped and defines a circular perimeter in the horizontal plane,
b. said compactor is essentially disc-like and has a generally circular perimeter, and
c. the diameter of said compactor is smaller than the diameter of said transfer and compacting chamber.

3. In the combined cover and compactor assembly as claimed in claim 1 wherein said retaining means comprises,
a. at least two spaced locking lugs projecting inwardly from said side wall,
b. rim means extending inwardly from the side wall to define an upper end opening and formed thereon in spaced relation to said locking lugs, and
c. said locking lugs and said rim cooperate with said side wall to define a retaining track to engage the perimeter of said compactor when said compactor functions as a cover for said assembly.

4. In the combined cover and compactor assembly as claimed in claim 3 wherein said retaining means includes a braking means located on said side wall adjacent said rim, to engage said compactor when said compactor is positioned within said retaining track.

5. In the combined cover and compactor assembly as claimed in claim 4 wherein said braking means comprises, a plurality of braking surfaces having thickened planar wall segments disposed within said retaining track, and auxiliary braking surfaces comprising thickened wall surfaces spaced between said locking lugs.

6. In the combined cover and compactor assembly as claimed in claim 5 wherein said auxiliary braking surfaces include braking surface lands having beveled surfaces extending between said auxiliary braking surfaces and said side wall.

7. In the combined cover and compactor assembly as claimed in claim 3 wherein said retaining means includes a braking means defined by at least one thickened planar section located on said side wall.

8. In the combined cover and compactor assembly as claimed in claim 4 wherein at least one braking means is disposed in a retaining track.

9. In the combined cover and compactor assembly as claimed in claim 4 wherein;
a. at least one of said braking means is disposed in a retaining track and
b. at least two other braking means are disposed opposite each other and between the locking lugs.

10. In the combined cover and compactor assembly as claimed in claim 3 wherein said compactor comprises, a disc shaped plunger with a generally circular peripheral edge, and a handle attached to a broad surface of said plunger for hand grasping said compactor.

11. In the combined cover and compactor assembly as claimed in claim 3 wherein said compactor further includes, release means in said peripheral edge to permit said compactor to be disengaged from said retaining means.

12. In the combined cover and compactor assembly as claimed in claim 11 wherein said release means comprises, spaced cut-outs in said peripheral edge corresponding in number to said locking lugs and sized to permit said compactor to move freely past said lugs when said cut-outs and said lugs are aligned.

13. In the combined cover and compactor assembly as claimed in claim 12 wherein at least two locking lugs and at least two cut-outs are present and the locking lugs are disposed diametrically opposite each other on the side wall.

14. In the combined cover and compactor assembly as claimed in claim 1 wherein said housing support includes an annular shoulder located about the lower end opening, said annular shoulder sized to engage the open end of said container.

15. In the combined cover and compactor assembly as claimed in claim 14 wherein said annular shoulder has a larger diameter then said side wall.

16. In the combined cover and compactor assembly as claimed in claim 14 wherein a beveled section is formed on the side wall between the portion of the side wall defining the transfer and compacting chamber and the annular shoulder to guide returning movement of said compactor.

17. The assembly of claim 1 wherein said inlet includes a door for closing off said side opening.

18. A retaining means for a combined cover and compactor assembly including,
a. housing means having a side wall,
b. spaced locking lug means extending inwardly from said side wall,
c. rim means extending inwardly from said side wall and spaced from said locking lug means to define a retaining track, and
d. at least one brake means on said side wall operatively associated with said locking lugs.

19. In a retaining means as claimed in claim 18 including,
an auxiliary brake means on said side wall disposed in spaced relation to said locking lugs.

* * * * *